US007555926B2

(12) United States Patent
Trim

(10) Patent No.: US 7,555,926 B2
(45) Date of Patent: Jul. 7, 2009

(54) TEMPERATURE CONTROL MECHANISM FOR USE IN THE MANUFACTURING OF METAL CONTAINERS

(75) Inventor: Matthew Trim, Arvada, CO (US)

(73) Assignee: Ball Corporation, Broomfield, CO (US)

( * ) Notice: Subject to any disclaimer, the term of this patent is extended or adjusted under 35 U.S.C. 154(b) by 326 days.

(21) Appl. No.: 11/255,412

(22) Filed: Oct. 20, 2005

(65) Prior Publication Data

US 2007/0107209 A1 May 17, 2007

(51) Int. Cl.
*B21D 37/16* (2006.01)
*B21D 51/26* (2006.01)

(52) U.S. Cl. ..... 72/342.3; 72/405.03; 72/94

(58) Field of Classification Search ..... 72/38, 72/94, 342.1, 342.2, 342.3, 342.7, 405.03, 72/379.4; 29/722, 39, 40; 454/184; 62/DIG. 10; 198/952

See application file for complete search history.

(56) References Cited

U.S. PATENT DOCUMENTS 4,007,621 A 2/1977 Franek et al.
6,299,804 B1 * 10/2001 Domodossola et al. ... 264/37.17
6,722,102 B1 * 4/2004 Pape et al. ..... 53/410

* cited by examiner

*Primary Examiner*—Dana Ross
*Assistant Examiner*—Debra M Sullivan
(74) *Attorney, Agent, or Firm*—Sheridan Ross P.C.

(57) ABSTRACT

A cooling mechanism is provided to control the direction of flow of cooled air in an apparatus used to manufacture metallic containers, wherein machinery wear is reduced and the tolerance of the finished factory container height is maintained within a predetermined tolerance.

16 Claims, 2 Drawing Sheets

TEMPERATURE CONTROL MECHANISM FOR USE IN THE MANUFACTURING OF METAL CONTAINERS

FIELD OF THE INVENTION

The present invention relates to an apparatus and method for manufacturing a metallic container, and more specifically a temperature control mechanism used in a container beader.

BACKGROUND OF THE INVENTION

During the manufacturing of containers, and more specifically metallic containers, a number of variables determine the overall finished factory can height (FFCH). These variables include the temperature used during the manufacturing process, wherein variations of the temperature create expansion or contraction of the metallic material, and thus a variation in the FFCH. When the FFCH varies beyond an acceptable amount, end users may reject the finished product, thus resulting in excess waste and expense. Furthermore, changes in the FFCH may result in structural deformities within the container, and thus compromise the integrity of the container and ultimate failure.

Furthermore, excessive temperatures during manufacturing can result in unwanted and costly machinery wear as metallic components expand and contract in an uncontrolled manner. Thus, the regulation of the temperature during the manufacturing process is critical, and more specifically in the present application with regard to the use of a beader in a container manufacturing plant.

A beader is an apparatus used to provide a bead or a seam in a metallic container such as a tin can. The bead or groove enhances the structural integrity and strength of the container, and thus is critical during can manufacturing for certain types of metallic containers. One specific application is in the packaging of containers used to store vegetables, and other perishable foods which are retorted during the filling process, wherein heat is applied to the filled container to kill unwanted bacteria and place the container in a vacuum after cooling. Thus, the structural integrity of the container and the FFCH is critical for shipping purposes and end user satisfaction.

Common beader manufacturing equipment utilizes a cooling system which has been found to be inadequate to control the FFCH. More specifically, existing beader manufacturing equipment generally comprises a beader chamber which encloses a beader turret and plurality of mandrels. Each of the mandrels retain a container which rotates around a turret frame and applies a seam to the metallic container. A cooling system is operably interconnected to the cooling chamber, and cooled air is forced into the chamber to maintain the beader turret at a preferred temperature. However, it has been found that commonly used cooling systems and beader chambers are inadequate to properly control the beader turret temperature, and more specifically the mandrel which is operably engaged to a container. Thus, unwanted temperature fluctuations in the mandrel can occur, thus causing unacceptable variations in the FFCH during manufacturing. Thus, there is a significant need in the container manufacturing industry to identify a cost efficient solution to maintaining the temperature of the beader and more specifically the mandrel during the beading operation to assure that the FFCH is within an acceptable range for structural integrity of the container and end user satisfaction.

SUMMARY OF THE INVENTION

It is thus one aspect of the present invention to provide an energy efficient cooling mechanism which is used in combination with a piece of equipment in a metallic container manufacturing plant. Thus, in one embodiment of the present invention an improved apparatus for an existing cooling mechanism is utilized to direct a channel of cooled air around a beader turret in a beader apparatus which is used to provide a seam or bead in a metallic container. Alternatively, the present invention may be used with other apparatus used to shape or alter a metallic container depending on the specific application.

Accordingly, in one embodiment of the present invention one or more "shrouds" are utilized within the beader chamber to redirect cooled air specifically around a beader turret which has a plurality ofmandrels interconnected thereto. Thus, cooled air is specifically directed to the mandrel and container. The cooling mechanism of one embodiment of the present invention regulates the temperature of the mandrel within a range of about 0.5-3.0 degrees Fahrenheit. Preferably, the temperature of the mandrel is maintained within a range no greater than about 20° F. It is another aspect of the present invention to provide a preferred geometry to the shroud wherein the cooled air is directed to a predetermined location with respect to the beader turret and beader mandrel. In one embodiment the shrouds employed are open and have a generally c-shaped cross section. Thus, in one embodiment of the present invention, a left turret is used in conjunction with a right turret wherein air flow is directed in one direction around a substantially cylindrical shaped beader turret, while air flow on the opposing side is directed in an opposite direction around the exterior surface of the beader turret to provide maximum cooling efficiency. In one embodiment of the present invention the flow rate and a temperature of air discharged from the cooling mechanism is dictated by the ambient air temperature entering said cooling assembly. In another embodiment of the present invention the flow rate and a temperature of air discharaed from the cooling mechanism is determined by the speed of operation of the turret.

It is another aspect of the present invention to provide one or more shrouds which can be implemented in a variety of different sizes and geometric configurations, and can thus be adapted for use in a variety of different types of equipment. Thus, in one embodiment an arcuate shaped pair of shrouds are utilized to redirect air around a circumferential surface of a beader turret. Alternatively, other shapes can be utilized which are shaped to direct a flow of cooled air in a predetermined direction or location. In one embodiment of the present invention the shroud is comprised of at least one of a metallic material, a ceramic material, and a fiberglass material.

Thus in one embodiment of the present invention, a cooling assembly is provided which is adapted for use as an apparatus for altering the shape of a metal container, generally comprising:

a frame;

a turret supported by said frame, said turret comprising a plurality of mandrels, each of said mandrels adapted for retaining a metallic container;

a chamber substantially enclosing said turret;

a cooling system, wherein an intake air temperature entering said cooling system is greater than a discharge air temperature;

a conduit operably interconnecting a discharge port of said cooling system to an inlet in said chamber; and at least one shroud in operable communication with the chamber inlet, said shroud shaped to substantially direct cooled air around a circumference of said turret, wherein the temperature of the turret and mandrels can be maintained within a pre-determined range.

It is a further aspect of the present invention to provide a method for controlling the temperature of an apparatus used to alter the geometry of the metal container. More specifically, in one aspect of the present invention a method is provided to redirect cooled air in an apparatus used in a container manufacturing plant to a predetermined location or in a given direction. Thus, in one embodiment of the present invention one or more shrouds are used in conjunction with an apparatus used to provide a seam or bead in a metallic container used for the storage of food or beverages. Thus, a method is provided herein for controlling the temperature of an apparatus used to alter the geometry of the metal container, and which generally comprises:

providing an apparatus having a frame, a turret rotatably interconnected to said frame, and a chamber substantially enclosing said turret;

providing a plurality of mandrels operably interconnected to said turret, each of the mandrels adapted to hold a metallic container;

providing a cooling mechanism operably interconnected to at least one entry port of said chamber, said cooling mechanism adapted to reduce the temperature of ambient air; and controlling the direction of cooled air within said chamber, wherein the cooled air travels around a perimeter surface of the turret to control the temperature of the turret and a plurality of mandrels positioned proximate thereto.

BRIEF DESCRIPTION OF THE DRAWINGS

The accompanying drawings are incorporated into and form a part of the specification to assist in explaining the present invention. The drawings are intended for illustrative purposes only and are not intended as exact representations of the embodiments of the present invention. The drawings further illustrate preferred examples of how the inventions can be made and used and are not to be construed as limiting the inventions to only those examples illustrated and described herein. The various advantages and features of the present inventions will be apparent from a consideration of the drawings in which.

DETAILED DESCRIPTION

Figure 1:
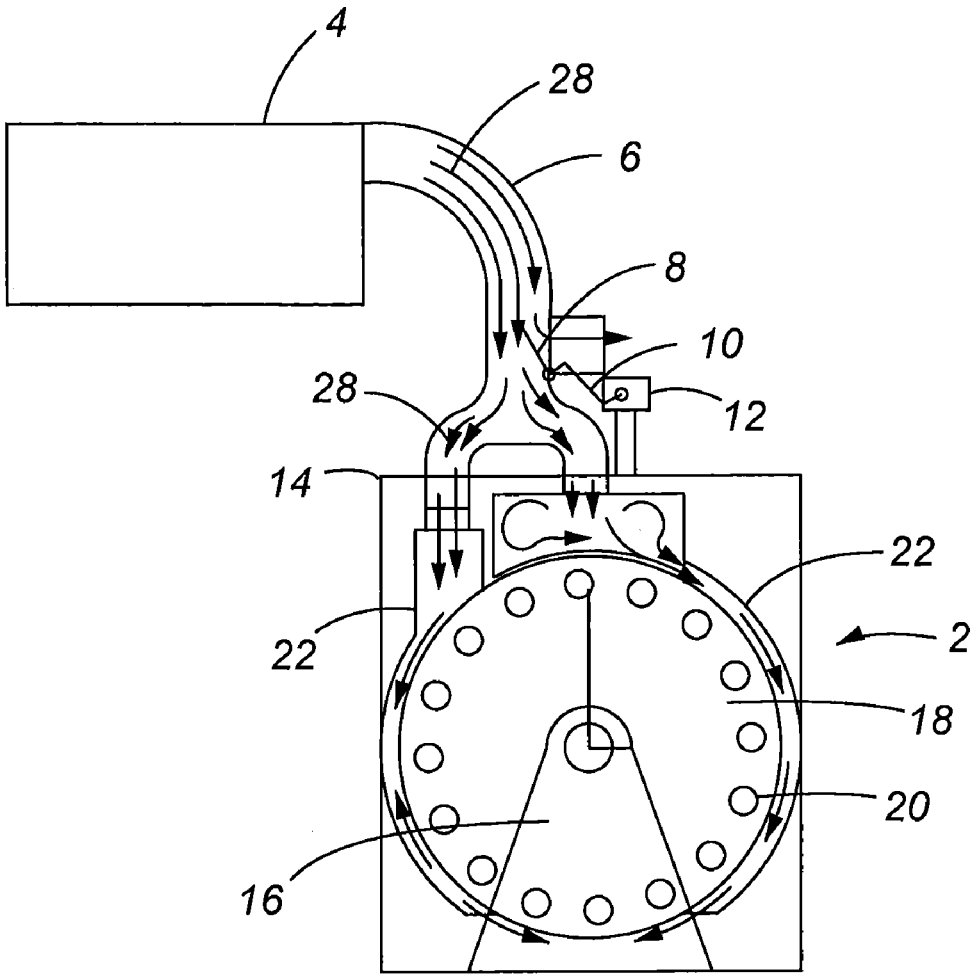
FIG. 1 is a cross-sectional cut-away view of a cooling apparatus used in a container beader mechanism, and generally showing the components therein.

Referring now to the drawings, FIG. 1 depicts a cross-sectional front elevation view of a container beader apparatus which is operably interconnected to a cooling system 4. More specifically, the beader 2 is generally comprised of a beader chamber 14 which encloses a beader turret 18, and which rotates on a beader frame 16. The beader turret 18 generally comprises a substantially cylindrically shaped outer circumference, and a plurality of mandrels 20 which are used for operable engagement to a metallic container during the beading operation. As previously discussed herein, a beader is used in a metallic container manufacturing plant to provide a bead or a seam within the container body to improve the structural integrity and overall strength of the container. However, as appreciated by one skilled in the art, the cooling apparatus and invention provided herein may be applied to any number of apparatus used in a container manufacturing plant or other manufacturing facility, and it is not limited herein to beaders or the manufacturing of metallic containers. Rather, the present invention may be utilized in any manufacturing process where cooled air is required in a predetermined location or to flow in a predetermined direction.

The beader chamber 14 is operably interconnected to a cooling system 4 by a means of duct work 6 or other materials common in the art which are generally made out of sheet metal, tin, or other materials. One example of a cooling system 4 suitable for this purpose is a Trane air conditioner which is capable of producing about 1000 cubic feet per minute of air cooled to a temperature of 65° F. However, as appreciated by one skilled in the art, any type of cooling mechanism could be used for the same purpose, and the volume, output and exact temperature is not critical to the present invention. The duct work 6 of the present invention may include a damper 8 or other similar mechanism to control the volume of flow entering the beader chamber 14, and which may be interconnected to a jackshaft 10 and modulating motor 12. Thus, depending on the outside air temperature, volume of air required and other variables, the total volume of air entering the beader chamber 14 can be operably controlled with thermostatic devices and other means well known in the art.

Referring again to FIG. 1, one aspect of the present invention includes one or more shrouds 22 which are positioned within the beader chamber 14, and which are designed to redirect the volume of cooled air entering the beader chamber 14 to a preferred location or in a predetermined direction. More specifically, in one embodiment of the present invention the shroud 22 includes a left-handed shroud and a right handed shroud which are oriented to direct the air flow 28 around the circumferential surface of the beader turret 18.

Figures 2, 3:
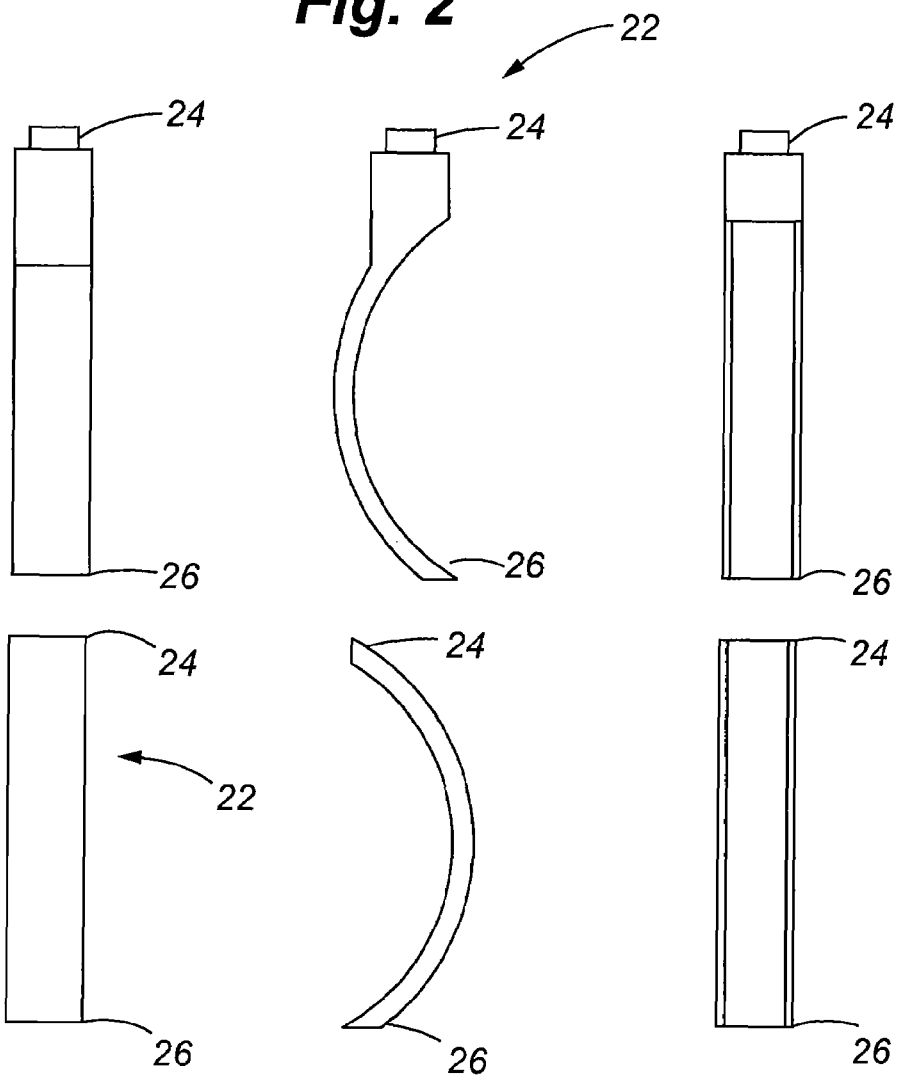
FIG. 2 is a cross-sectional view of a left handed shroud shown from a rear view, side view, and front view respectively, and which is installed within a beader chamber.
FIG. 3 is a cross-sectional elevation view of a right-handed shroud shown from a rear view, side view, and front view, respectively of a right-handed shroud used in a container beader apparatus.

Referring now to FIGS. 2 and 3, cross-sectional views of a left-handed shroud and right-handed shroud are provided herein. More specifically, FIG. 2 and FIG. 3 show a rear view, a side view, and a front view respectively as shown from left to right of a left-handed turret in FIG. 2, and a right-handed turret in FIG. 3. These turrets are positioned within the beader chamber 14 as shown in FIG. 1, and generally comprise an upper portion 24 and a lower portion 26 and a predetermined geometry defined therebetween. In use, cooled air enters the upper portion 24 of the turret and air is directed downwardly and around the arcuate shape of the shroud toward a lower portion 26. As the air flow is directed around the shroud 22, the cooled air maintains the mandrel 20 and associated container within a specific temperature range during the manufacturing process. Thus, the cooled air flow 28 entering the beater chamber 14 is redirected to a preferred location around the beader turret 18 and mandrel 20 to improve the operating efficiency of the beader and keep the metallic containers within a predetermined temperature for optimum efficiency and to assure FFCH. As appreciated by one skilled in the art, the shrouds are not limited to an arcuate shape. Rather, the geometry of the shroud is dictated by the desired use and type of equipment which requires cooling.

The embodiments shown and described above are exemplary. Many details are often found in the art and therefore many such details are neither shown nor described. It is not claimed that all the details, parts, elements, or steps described and shown were invented herein. Even though numerous characteristics and advantages of the present inventions have been described in the drawings and accompanying text, the description is illustrative only, and changes may be made in the detail, especially in matters of shape, size, and arrangements of the parts and the principles of the invention to the extent indicated by the broadening of the terms of the attached claims.

For clarity, the following is a list of components generally shown in the drawings:

| No. | Components |
|---|---|
| 2 | Beader |
| 4 | Cooling system |
| 6 | Ductwork |
| 8 | Damper |
| 10 | Jackshaft |
| 12 | Modulating motor |
| 14 | Beader chamber |
| 16 | Beader frame |
| 18 | Beader turret |
| 20 | Mandrel |
| 22 | Shroud |
| 24 | Shroud upper end |
| 26 | Shroud lower end |
| 28 | Air flow |

What is claimed is:

1. A cooling assembly adapted for use with an apparatus for altering the shape of a metallic container, comprising:

a frame;

a turret supported by said frame, said turret comprising a plurality of mandrels, each of said mandrels adapted for retaining at least one metallic container;

a chamber substantially enclosing said turret;

a cooling system, wherein an intake air temperature entering said cooling system is greater than a discharge air temperature exiting a discharge port of said cooling system;

a conduit operably interconnecting said discharge port of said cooling system to an inlet in said chamber such that air discharged from said cooling system is directed into said chamber;

a first opened shroud, which possesses a generally c-shaped cross section in operable communication with said inlet of said chamber, said first opened shroud shaped to direct cooled air from said cooling system around a portion of the circumference of said turret that is adjacent to said first opened shroud;

a second opened shroud, which possesses a generally c-shaped cross section in operable communication with said inlet of said chamber and spaced from said first opened shroud, said second opened shroud shaped to direct cooled air from said cooling system around a portion of the circumference of said turret that is adjacent to said second opened shroud; and wherein the discharged air is operably divided and directed to said first opened shroud and said second opened shroud and directed generally around the circumference of said turret, wherein the temperature of the turret and said mandrels can be maintained within a pre-determined range.

2. The cooling assembly of claim 1, wherein said first opened shroud and said second opened shroud have arcuate-shaped portions.

3. The cooling assembly of claim 1, wherein said first opened and said second opened shroud have at least one portion with a radius of curvature which is proximate to the radius of curvature of the circumference of the turret.

4. The cooling assembly of claim 1, wherein said cooling system regulates the temperature of the mandrel within a range of about 0.5-3.0 degrees Fahrenheit.

5. The cooling assembly of claim 1, wherein said first opened shroud and said second opened shroud are comprised of at least one of a metallic material, a ceramic material, and a fiberglass material.

6. The cooling assembly of claim 1, wherein said cooling system further comprises a damper and a modulating motor, wherein ambient air can be commingled with the cooled discharge air prior to introduction into said chamber inlet.

7. The cooling assembly of claim 1, wherein the apparatus is a beader used in a metallic container manufacturing plant to selectively alter the geometry of the metallic container in a predetermined location.

8. A cooling assembly adapted for controlling an air temperature in a metallic container beader comprising a frame, a turret supported by the frame and a chamber substantially enclosing the turret, comprising:

a cooling assembly with an air inlet port and an air outlet port, wherein the temperature of air discharged from said outlet port is less than the temperature of air entering the inlet port;

a conduit interconnected on a first end to said outlet port and a second end to an inlet of said chamber such that air discharged from said cooling assembly is directed into said chamber;

a first opened shroud, which possesses a generally c-shaped cross section in operable communication with said inlet of said chamber, said first opened shroud shaped to direct cooled air from said cooling system around a portion of the circumference of said turret that is adjacent to said first opened shroud;

a second opened shroud, which possesses a generally c-shaped cross section in operable communication with said inlet of said chamber and spaced from said first opened shroud, said second opened shroud shaped to direct cooled air from said cooling system around a portion of the circumference of said turret that is adjacent to said second opened shroud; and wherein the discharged air is divided and directed to said first opened shroud and said second opened shroud and substantially directed around the circumference of said turret.

9. The apparatus of claim 8, wherein said first opened shroud and said second opened shroud have an arcuate shape.

10. The apparatus of claim 8, wherein said turret further comprises a plurality of mandrels which are adapted to receive a metallic container.

11. The apparatus of claim 8, wherein said first opened shroud and said second opened shroud substantially direct air flow around a circumferential exterior surface of the turret.

12. The apparatus of claim 8, wherein at least one of an air temperature and rate of flow of cooled air entering the chamber is selectively controlled based on the speed of operation of the turret.

13. The apparatus of claim 8, wherein said first opened shroud and said second opened shroud is comprised of a metallic material.

14. A method for controlling the temperature of a beader used to alter the geometry of a metallic container, comprising:

providing an apparatus having a frame, a cylindrical shaped turret rotatably interconnected to said frame, and a chamber substantially enclosing at least said turret;

providing a plurality ofmandrels operably interconnected to said turret, each of the mandrels adapted to hold at least one container;

providing an open cooling mechanism operably interconnected to at least one entry port of said chamber, said cooling mechanism adapted to reduce the temperature of ambient air; and controlling the direction of cooled air within said chamber, wherein the cooled air is directed around a perimeter surface of the turret to control the temperature of the turret and plurality of mandrels while the geometry of the metallic container is altered, said controlling comprising directing air around a first portion of the circumference of said turret that is adjacent to a first opened shroud and directing cooled air from said cooling system around a second portion of the circumference of said turret, wherein the temperature of the turret and said mandrels can be maintained within a pre-determined range.

15. The method of claim 14, wherein the turret operating temperature is maintained within a range no greater than about 2° F.

16. The method of claim 14, wherein controlling the direction of cooled air comprises employing at least one shroud with an arcuate shape.

* * * * *